United States Patent [19]

Johannesson

[11] Patent Number: 5,012,576

[45] Date of Patent: May 7, 1991

[54] PERSONAL HAIR TRIMMER

[76] Inventor: Jimmie R. Johannesson, 11689 - 64B Ave., Delta, B.C., Canada, V4E 2E1

[21] Appl. No.: 554,616

[22] Filed: Jul. 18, 1990

[51] Int. Cl.[5] ..... B26B 19/00

[52] U.S. Cl. ..... 30/29.5; 30/41.5; 30/133

[58] Field of Search ..... 30/29.5, 32, 41.5, 41.6, 30/133, 43.6, 346.51, 347

[56] References Cited

U.S. PATENT DOCUMENTS 2,598,212 5/1952 Blair ..... 30/41.5

4,958,432 9/1990 Marshall ..... 30/29.5

*Primary Examiner*—Douglas D. Watts

*Attorney, Agent, or Firm*—Townsend and Townsend

[57] ABSTRACT

A hand held hair trimmer for trimming hair in nose and ears has a cutter action and fan like action to collect the cut hair. The trimmer comprises a hand held container with a battery and motor therein, a rotatable shaft extends from the motor to one end of the container which has a screen with apertures of sufficient size to allow hairs to pass therethrough. The screen is semispherical in shape and joined to a cylindrical portion. A cutting head is attached to the end of the shaft and rotates within the screen with the blades arranged to cut hairs protruding through the screen, and being angled to provide a fan like action when rotated. A removable filter is located within the container adjacent the screen to cut hair trimmings and a vent is located in the container to vent air pulled into the container from the rotating blades, the air vent is down stream from the filter.

3 Claims, 1 Drawing Sheet

PERSONAL HAIR TRIMMER

BACKGROUND OF THE INVENTION

The present invention relates to a hand held hair trimmer for trimming hair in nose and ears.

The trimming of hair in nostrils and ears is not easy for an individual to do with scissors because of the difficulty of performing the operation while looking in a mirror. The mirror image is reversed which sometimes leads to pinching or cutting the skin and not cutting the hair. Different types of personal hair trimmers have been considered. Hand held trimmers that are battery operated are available, however, in a lot of cases they tend to pull the hair rather than cut it. One particular personal trimmer for nose and ears has reciprocating blades with one blade behind the other. This also tends to cut the skin as well as the hair. In another trimmer, two coaxial heads are provided each having blades which counter rotate and cut hair between the heads. Skin can on occasions be pinched between the heads. Another trimmer has vibrating cutting heads and if the heads touch the nose, the vibration causes tears to form and in some cases causes the nose to run.

SUMMARY OF THE INVENTION

I have developed a personal trimmer for nose and ears which has a screen with apertures large enough to allow the hair to enter therein and has a cutter blade rotating within the screen to shear off all hair that extends through the holes in the screen. Furthermore, I also provide the cutter blade with a fan-like action to pull air in through the screen together with cut hairs and trap the hairs in a filter. The filter can be cleaned out from time to time by removing the screen and the rotating blade. The screen may be replaced against the skin like an electric razor, but does not vibrate nor does it allow the skin to be pinched or cut.

The present invention provides a hair removal device for nose and ears comprising a hand holdable container containing a power source and motor, with a rotatable shaft extending from the motor to one end of the container; metal screen at the one end of the container having apertures of sufficient size to allow hairs to pass therethrough, the metal screen semispherical in shape at the end and joined to a cylindrical portion; cutting head attached to the rotatable shaft to rotate within the screen, the cutting head having blades to follow inside contour of the metal screen, the blades adapted to cut hairs protruding through the screen, and being angled to provide fan-like action when rotated; removable filter located within the container adjacent the screen, adapted to catch hair trimmings, and vent located in the container to vent air pulled in by the fan-like action of the blades on the cutting head when rotated by the motor, the air entering through the screen, passing through the filter and exiting through the vent.

BRIEF DESCRIPTION OF THE DRAWINGS

In drawings which illustrate embodiments of the present invention.

DETAILED DESCRIPTION OF THE INVENTION

Figure 1:
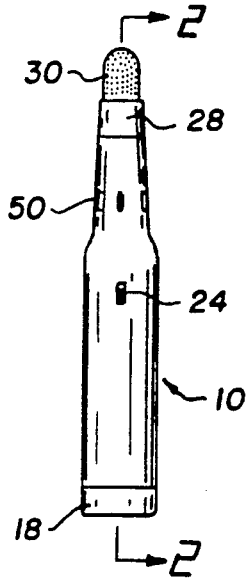
FIG. 1 is a side view of a hair removal device according to one embodiment of the present invention.
Figure 2:
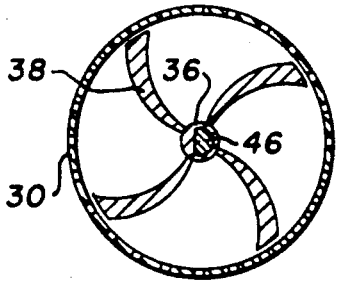
FIG. 2 is a sectional side view of the hair removal device shown in FIG. 1 at line 2—2.

The hair removal device according to the present invention is preferably made out of a molded plastic material with a metal screen and cutting head. A container 10, which is approximately four inches long and about one inch in diameter, contains a battery 12 preferably a size AA or size C cell which in turns powers a small rotatable motor 14. The container 10 has a casing 16 with an end cap 18 having a screw means or in another embodiment a bayonet type fitting, to attach to the casing 16. A grounding strip 20 is shown in the cap 18 and a lead is provided on the inside of the casing 16 to the motor 14. The motor 14 is held in place by a clip 22 or other suitable attachment arrangement, and an operating switch 24 is provided to make and break contact between the motor 14 and the battery 12. The operating switch 24 may be either a push button type switch that is or one that slides backwards and forwards and may be left in the on position if desired.

The container 10 tapers down at the front to terminate at a threaded portion 26 which is in the order of $\frac{3}{8}$ of an inch in diameter. A threaded collar 28 attaches to the threaded portion 26 of the container 10 and holds a metal screen 30 in place. A circular washer 32 is contained between the collar 28 and the threaded portion 26. The circular washer 32 is generally formed of a plastic material and has a filter 34 integral therewith extending inwards to catch and retain hair trimmings during operation of the device. The filter may be cloth or in some cases a coarse paper. Replacement filters are made available.

The metal screen 30 is preferably made of stainless steel and in one embodiment varies in thickness from 0.020 inches to 0.035 inches. The apertures in the screen 30 in one embodiment are round and vary from 0.035 inches to 0.045 inches. The screen has a semispherical end portion which is integral with a cylindrical portion. Rotating inside the screen is a cutting head 36 which like the screen 30 has an end portion which has blades 38 that exactly fit within the semispherical portion of the screen 30. The blades 38 further extend down the cylindrical portion of the cutting head 36 and are angled to provide a fan-like action when they rotate to pull air into the screen. The cutting blades 38 also rotate substantially adjacent to the inside surface of the cylindrical portion of the screen 30. A cutting action occurs between the blades 38 and the inside surface of the screen 30 so that all hairs that protrude through the screen 30 are sheared off by the rotting blades 38.

Figure 3:
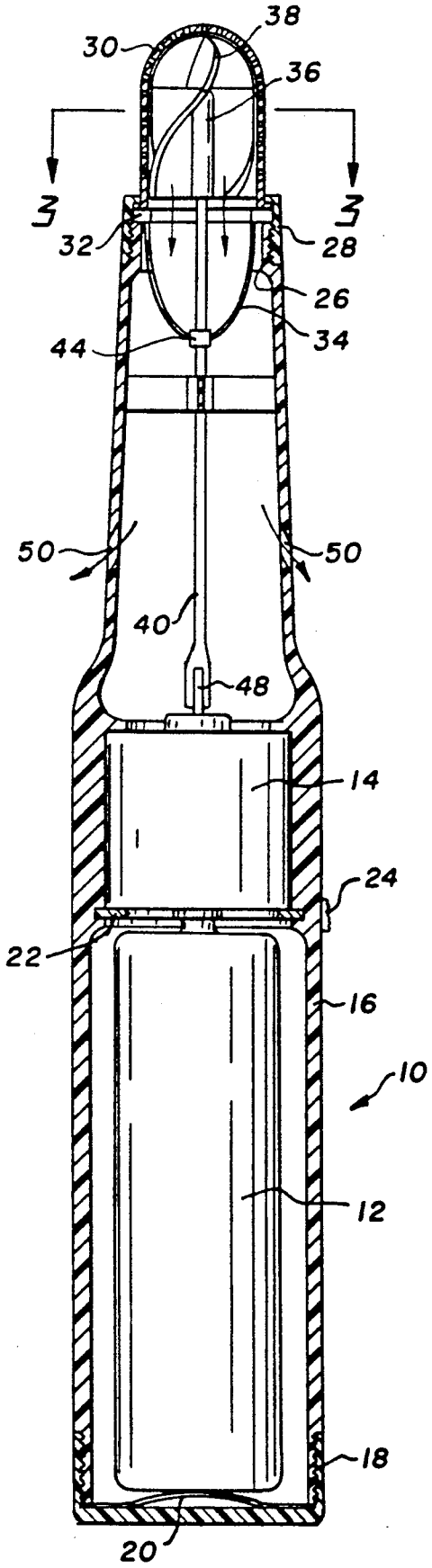
FIG. 3 is a sectional view through the cutting head and screen of the hair removal device shown in FIG. 2 at line 3—3.

A drive shaft 40 from the motor 14 extends up through a bushing 42 and a collar portion 44 at the center of the filter 34, terminating in an end 46 which has one flat side as shown in FIG. 3 to engage in a mating hole provided in the cutting head 36. A coupling 48 generally made of plastic with an insertion plug, connects the shaft 40 to the motor 14.

Vents 50 being slots or holes, are provided in the side of the container 10 below the filter 34. The vents 50 permit air which is being sucked in by the fan-like action of the blades 38 through the screen 30, to pass through the filter 34 and exit through the vents 50. Thus hair trimmings cut between the blades 38 and the screen 30 are drawn in and retained by the filter 34. The cutting head 36 always rotates in one direction so that the blades 38 have a fan-like action pulling air in through the screen 30.

After use, it is necessary to unscrew the collar 28, take off the screen 30, and pull off the cutting head 36 which is merely a slip on fit over the flat end 46 of the shaft 40. The filter 34 can then be lifted out and any hair therein removed. The unit can then be reassembled for further use.

The motor is a standard available motor which is powered at 1½ volts by the battery. The batteries may be replaced, and if required rechargeable batteries used therein. The head being only ⅜ of an inch in diameter can be inserted into ears and nostrils without discomfort. Unlike the vibratory type of hair trimmers, there is substantially no vibration passed to the individual when the screen touches the skin.

Whereas apertures have been described in the screen 30, it will be apparent that these apertures may be slits, round holes, or other suitable shapes. As can be seen in FIG. 3 four blades 38 are provided for the cutting head 36, the blades 38 all extend from an axial sleeve fitting on the end 46 of the shaft 40, thus there is little restriction to prevent air from moving inwards. The blades are preferably stainless steel having a thickness in one embodiment of 0.035 inches.

Various changes may be made to the embodiments shown herein without departing from the scope of the present invention which is limited only by the following claims.

The embodiments of the present invention in which an exclusive property or privilege is claimed are defined as follows:

1. A hair removal device for nose and ears comprising a hand holdable container containing a power source and motor with a rotatable shaft extending from the motor to one end of the container;

metal screen at the one end of the container having apertures of sufficient size to allow hairs to pass therethrough, the metal screen semispherical in shape at the end and joined to a cylindrical portion;

cutting head attached to the rotatable shaft to rotate within the screen, the cutting head having blades to follow inside contour of the metal screen, adapted to cut hairs protruding through the screen, and being angled to provide fan-like action when rotated;

removable filter located within the container adjacent the screen, adapted to catch hair trimmings, and vent located in the container to vent air pulled in by the fan-like action of the blades on the cutting head when rotated by the motor, the air entering through the screen, passing through the filter and exiting through the vent.

2. The hair removal device according to claim 1 wherein the metal screen is formed of stainless steel and the blades of the cutting head are also formed of stainless steel.

3. The hair removal device according to claim 1 wherein the diameter of the metal screen is approximately ⅜ of an inch.

* * * * *